US006964069B2

(12) United States Patent
English et al.

(10) Patent No.: US 6,964,069 B2
(45) Date of Patent: Nov. 15, 2005

(54) FLOATING WAVE MAKING APPARATUS

(76) Inventors: Anthony Thomas English, 28391 Sheridan Dr., Laguna Beach, CA (US) 92677; Anthony Nathaniel English, 5 Manchester, Coto De Caza, CA (US) 92679

( * ) Notice: Subject to any disclaimer, the term of this patent is extended or adjusted under 35 U.S.C. 154(b) by 160 days.

(21) Appl. No.: 10/734,781

(22) Filed: Dec. 11, 2003

(65) Prior Publication Data

US 2005/0223483 A1 Oct. 13, 2005

(51) Int. Cl.[7] ..... A47K 3/10
(52) U.S. Cl. ..... 4/491; 405/79; 114/382
(58) Field of Search ..... 4/491; 405/79; 114/274, 282

(56) References Cited

U.S. PATENT DOCUMENTS 4,276,661 A * 7/1981 Baker ..... 4/491
4,522,535 A 6/1985 Bastenhof
4,720,210 A 1/1988 Stonor et al.
4,806,048 A 2/1989 Ito
4,999,860 A 3/1991 Chutter et al.
5,720,056 A * 2/1998 Aymes ..... 4/488
5,833,393 A 11/1998 Carnahan et al.
5,860,766 A 1/1999 Lochtefeld et al.
5,911,190 A 6/1999 Lochtefeld et al.
5,913,636 A 6/1999 Macaulay

* cited by examiner

*Primary Examiner*—Charles E. Phillips
(74) *Attorney, Agent, or Firm*—Gene Scott and Patent Law & Venture Group

(57) ABSTRACT

A wave making method positions a shallow draft vessel off-shore form a shoreline of a sea in a position whereby one side of the vessel is in parallel to the shoreline. A pump is used for pumping seawater into a tank interior to the vessel. When the vessel is filled, the water is lifted to a rim of a side of the tank nearest to the shoreline to thereby dump the water in the tank over a side of the vessel. The dumped water is directed outwardly from the vessel and falls onto a submerged curved platform attached to the vessel and which extends outwardly therefrom. The platform creates a wave that moves away from the one side of the vessel toward the shoreline and is suitable for surfing.

8 Claims, 2 Drawing Sheets

FLOATING WAVE MAKING APPARATUS

BACKGROUND OF THE INVENTION

Incorporation by Reference

Applicant(s) hereby incorporate herein by reference, any and all U.S. patents and U.S. patent applications cited or referred to in this application.

1. Field of the Invention

This invention relates generally to wave making machines for sport and enjoyment, and more particularly to a wave making apparatus capable of being positioned without mooring at any location adjacent a shoreline for making waves that are suitable for surfing.

2. Description of Related Art

The following art defines the present state of this field:

Bastenhof, U.S. Pat. No. 4,522,535 describes a surf wave generator, which can repeatedly produce and launch singular waves across the surface of a swimming pool. The waves are produced in the swimming pool by an adjacent water-filled caisson, which is coupled into the swimming pool at the base of the pool and caisson. Except for the opening into the pool, the caisson is sealed, and a charge of high-pressure air is vented into the upper portion, forcing the water from the chamber into the swimming pool in a single forceful motion. Through the use of a baffle, the expelled water is directed within the swimming pool to produce a surf wave propagating across the surface of the swimming pool away from the wave-generating caisson. The surf wave may be repeatably generated without synchronization to the previously generated waves. The surf wave generator can also be used in combination with other wave-generating systems to produce a complete repertoire of wave motions.

Stonor et al., U.S. Pat. No. 4,720,210 describes an apparatus for generating waves in a swimming pool comprising a reservoir, independent of and separate from the pool, the reservoir containing a volume of water to be supplied to one or more inlets communicating into the lower regions of the swimming pool, and one or more flow paths through which the water from the reservoir is fed to the or each inlet, the or each flow path including a flow control valve therein and a volume of air downstream of the associated control valve for entrainment with the water flowing to the swimming pool such that, on entry of the water into the swimming pool, a wave having a turbulent, air-containing wake is formed.

Ito, U.S. Pat. No. 4,806,048 describes an apparatus for producing an artificial wave, which comprises: an embankment provided in the sea in parallel to a shore so that the upper portion thereof is exposed above the sea, the embankment having on the off-shore side thereof a slope for causing sea water to crawl up over the embankment in the form of a wave, and on the inshore side thereof a vertical surfaces; a tank, having an open upper end, fitted to the embankment so as to be vertically movable along the vertical surface thereof, the tank having a capacity sufficient to receive sea water having crawled up over the slope of the embankment a plurality of times through the open upper end, a side wall on the inshore side of the tank being capable of being opened and closed; a main buoy, fixed onto a bottom wall of the tank, having buoyancy sufficient to cause substantially the entire of the tank to float up above the sea; and a tank supporting mechanism having a function of supporting the tank at a prescribed position above the sea, the tank supporting mechanism releasing the abovementioned function thereof when the tank is filled up with sea water and the side wall on the inshore side of the tank being opened; whereby the tank filled up with sea water falls down on the sea along the vertical surface of the embankment and sea water received in the tank is discharged, thereby producing an artificial wave suitable for surfing toward the shore.

Chutter et al., U.S. Pat. No. 4,999,860 describes an apparatus for generating waves in a swimming pool comprising a plurality of wave generating chambers each communicating with the pool through a below-the-water passageway and having a closed upper portion extending above the quiescent water level of the pool, each said upper portion having first passageway means connected via first fluid flow control means to a pneumatic wave-generating medium and second passageway means connected via second fluid flow control means to an aqueous wave generating medium, and operating means connected to said first and second fluid flow control means, said operating means being arranged, in one mode, to cause intermittent delivery of said pneumatic wave-generating medium to one of said chambers to create a first wave-forming effect while simultaneously blocking delivery of said aqueous wave generating medium to said one chamber and, in another mode, to cause delivery of said aqueous wave-forming medium to said one chamber to create a second wave-forming effect while simultaneously both blocking delivery of said pneumatic wave generating medium to said one chamber and venting said one chamber.

Carnahan et al., U.S. Pat. No. 5,833,393 describes a wave-forming generator, which can repeatedly produce and launch singular waves across the surface of a body of water. The wave generator includes an air compressor interconnected with are a large air pressure holding tank. A hydraulic actuated valve is fitted onto the air pressure tank. Piping is then connected to the valve and ran out and down to join and connect to several main water tubes, cannons, pipes, or anything that can take the form of along round elongated chamber. The elongated chambers are submerged just under the surface of the water, being anchored on an angle with the opened ends of the water chambers pointing upwardly. The opened ends of the elongated chambers face towards the artificial reef, shoreline, or the opposite end of the pool. To generate waves the control valve herein is opened and closed in short intervals and sequences which create sets of waves by allowing bursts of pressurized air from the air tank to be released into the water chambers forcing the water out the opened ends of the water chambers and into the body of water in a single forceful motion. The air then escapes out the opened ends of the water chambers following the water it just shot out therefore water rapidly refills back into the water chambers in between the actuation of the valve, preparing the water chambers for another wave formation sequence. This sequence is rapidly repeated to produce an ocean movement simulation.

Locktefeld et al., U.S. Pat. No. 5,860,766 describes a boat activated wave-generating device for use in a body of water. The wave-generating device preferably has wave forming sections that help to create wave shapes and wake formations upon which surfing and/or other skimming maneuvers can be performed. The wave forming sections are moved by the boat and have forward leading edges and upper flow forming surfaces. The device can be pivotally connected to the boat and pulled, or directly attached to the side of the boat hull. In operation, the device is moved through the water such that the forward leading edges are submerged to lift water onto the flow forming surfaces. Water flowing on and conforming to the surfaces is directed relatively upwardly and/or laterally across the surfaces, to create various wave shapes and wake formations thereon.

Lochtefeld et al., U.S. Pat. No. 5,911,190 describes a boat activated wave generator that can be operated in a deep body of water. The wave generator is pulled or otherwise pushed through the water, and has wave generating portions that scoop up water, to form wave shapes thereon, upon which various surfing and skimming maneuvers can be performed. The shape of the wave generator is such that it forms wave shapes, and various wave formations, and remains in substantial equilibrium in the water. The wave generator also forms wakes, and enhances the boat's wake, such that various skimming maneuvers, i.e., wake-boarding and water skiing can be performed.

Macaulay, U.S. Pat. No. 5,913,636 describes an ocean wave producing structure having a support structure and a web. The support structure is fixed to the ocean floor and the web is arranged with its up swell end lower than its down swell end so that ocean swells traveling over the web are forced upwardly to form into waves. The shape and characterstics of the waves vary depending upon the gradients of the sections of the web. The support structure allows ocean currents to flow through it and hence has a low impact upon the ocean environment.

Our prior art search with abstracts described above teaches: surf wave generator, an apparatus for generating waves, an apparatus for producing an artificial wave, an apparatus for generating waves in a swimming pool, a wave cannon, boat activated wave generators, and an ocean wave producing means, but does not teach the use of a freely floating vessel with means for producing waves suitable for surfing. The present invention fulfills these needs and provides further related advantages as described in the following summary.

SUMMARY OF THE INVENTION

The present invention teaches certain benefits in construction and use, which give rise to the objectives described below.

A wave making apparatus and method positions an unmoored shallow draft vessel off-shore from a shoreline of a sea in a position whereby one side of the vessel is in parallel to the shoreline. A pump is used for pumping seawater into a tank interior to the vessel. When the tank is filled, the water is lifted to a rim of a side of the tank nearest to the shoreline to thereby dump the water over the side of the tank and vessel. The water falls onto a submerged curved platform extending outwardly from the vessel. The platform directs the water into a wave that moves away from the one side of the vessel toward the shoreline and is suitable for surfing. To stabilize the vessel, a thruster is positioned so as to prevent the vessel from tilting.

A primary objective of the present invention is to provide an apparatus and method of use of such apparatus that yields advantages not taught by the prior art.

Another objective is to provide such an invention capable of producing surfing sized waves.

A further objective is to provide such an invention capable of being moved to a selected shoreline.

A still further objective is to provide such an invention capable of being stabilized at a selected position relative to the shoreline it is parked near.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings:

FIGS. 2–4 are sectional views taken along line 2, 3, 4 in FIG. 1, and showing the manner in which the waves are produced, wherein FIG. 2 shows a tank starting to be filled, FIG. 3 shows the tank fully filled, and FIG. 3 shows the tank being emptied over the side of the vessel so as to create a traveling wave moving away from the vessel and toward the shore.

DETAILED DESCRIPTION OF THE INVENTION

The above-described drawing figures illustrate the invention in at least one of its preferred embodiments, which is further defined in detail in the following description. Those having ordinary skill in the art may be able to make alterations and modifications in the present invention without departing from its spirit and scope. Therefore, it must be understood that the illustrated embodiments have been set forth only for the purposes of example and that they should not be taken as limiting the invention as defined in the following.

Figure 1:
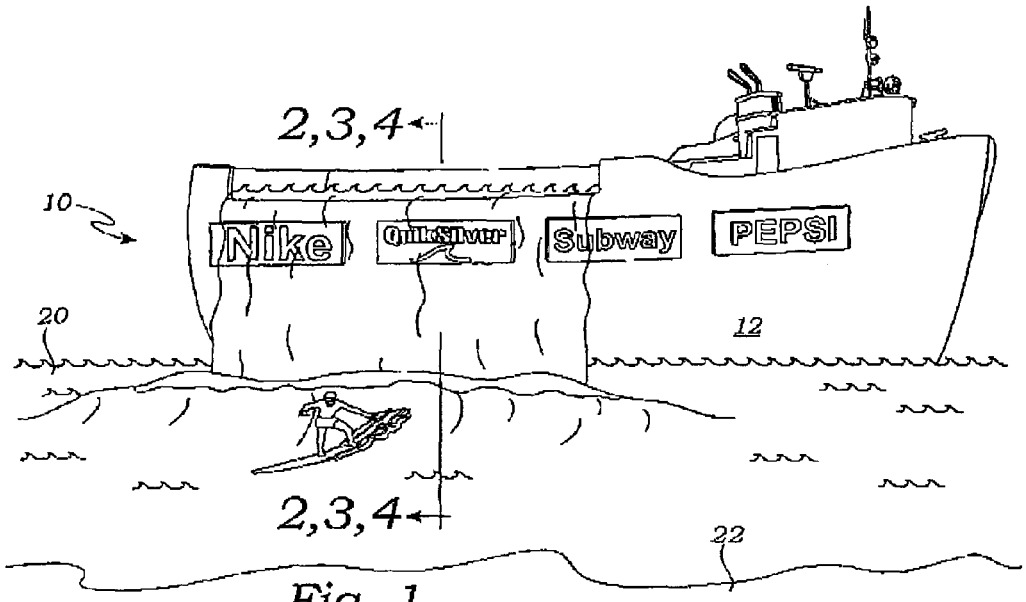
FIG. 1 is a side elevational view of the invention, a floating vessel capable of dispatching a volume of sea water to create large waves suitable for surfing.
Figure 2:
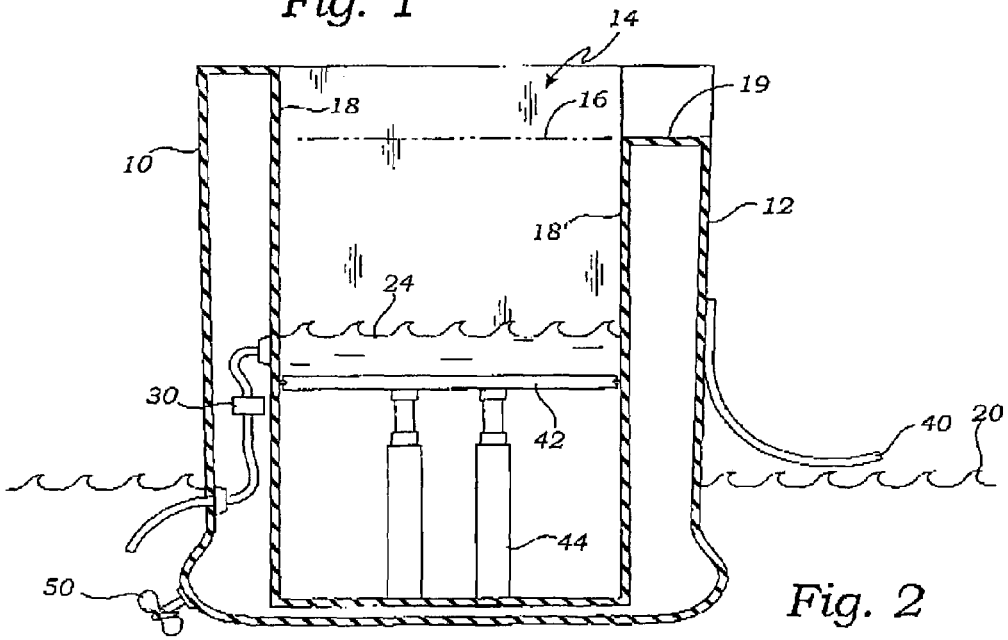
Figure 3:
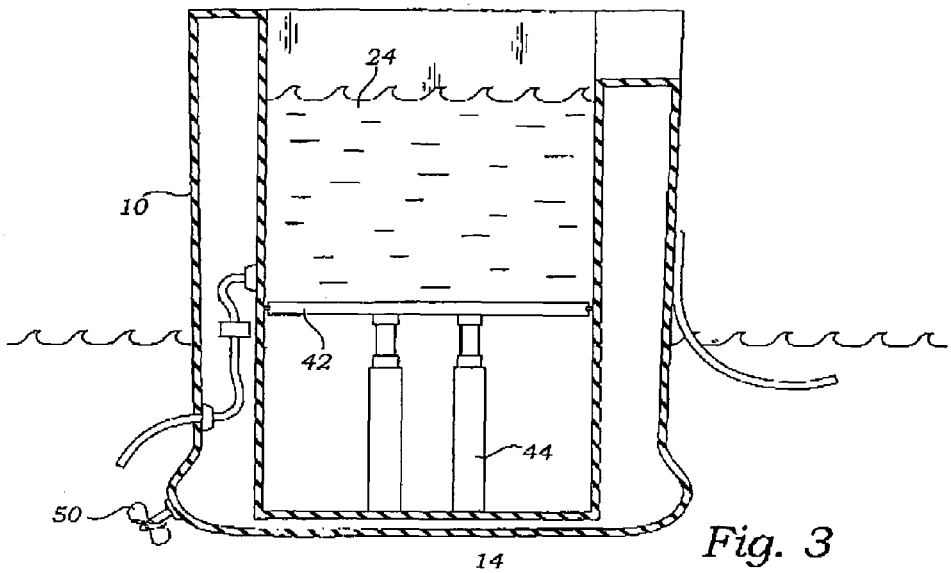
Figure 4:
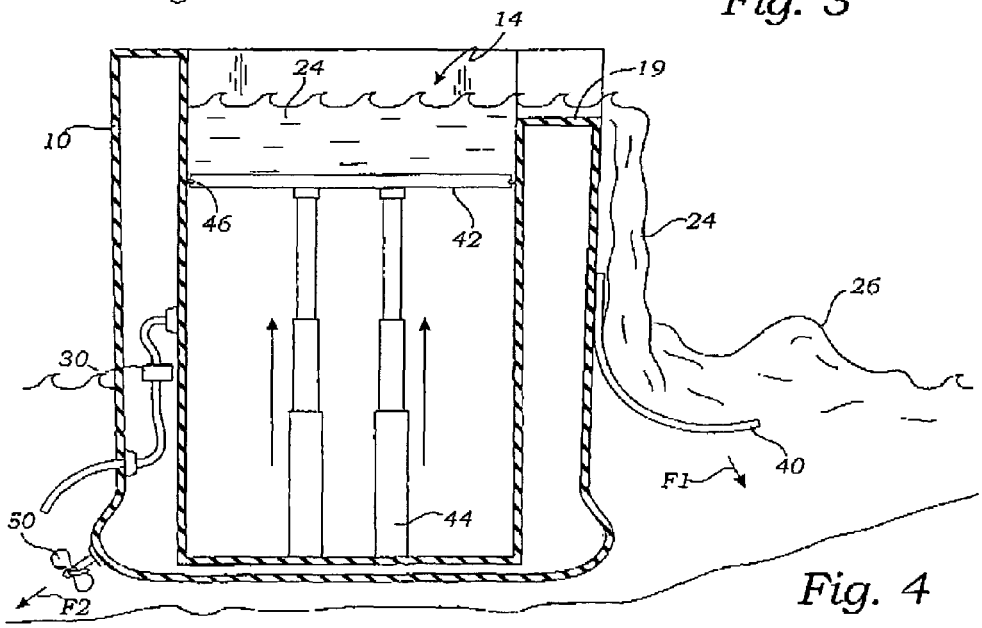

The present invention is a wave making apparatus, preferably a ship or similar vessel, selectively positioned offshore in a sea, wherein the word "sea" shall be used herein to mean an ocean, a lake, a bay, a river or any other body of water having a shoreline, where "shoreline" herein shall mean the general physical area where the body of water abuts a land mass or other stationary object such as a seawall, an embankment, a beach, a dyke, and the like. The apparatus, as shown in FIG. 1, preferably comprises an unmoored shallow draft vessel 10 such as a hip that is buoyant in the sea 20 and selectively positioned for presenting one side 12 of the vessel 10 in a parallel position to a shoreline 22. As shown in FIGS. 2–4, interior to the vessel 10 is a water tank 14 having an open top 16 defined by spaced apart tank sidewalls 18. One of the sidewalls 18' is positioned along the one side 12 of the vessel and provides a rim 19 which is positioned below the other of the sidewalls 18 of the tank 14 and substantially above a surface of the sea 20. A pump 30 is engaged with the tank 14 enabling the pumping of seawater 24 into the tank 14. A means for lifting the water 24 in the tank 14 to the open top 16 enables spilling the water 24 over the one sidewall 18' so that the water 24 falls exterior to the one side 12 of the vessel 10. A curved platform 40 is engaged with, and extends outwardly from the one side 12 of the vessel 10. The platform 40 is substantially submerged when the tank 14 is filled (FIG. 3), but may not be when the tank is essentially empty (FIG. 2) and the vessel 10 has greater buoyancy. As shown in FIG. 4, the platform 40 is positioned for receiving the water 24 as it is discharged from the tank 14 so as to thereby create a wave 26 moving away from the one side 12 of the vessel 10 toward the shoreline 22, the wave 26 being suitable in size and motion for surfing. Clearly, if the shoreline is a beach, the wave 26 will crest and present a surface for riding a surfboard up onto a beach.

Preferably, the water lifting means is a platform 42 mounted on a hydraulic actuator 44 so that the platform 42 is movable from a position at a bottom of the tank 14, as shown in FIG. 2, to a position substantially adjacent the rim 19 of the one side wall 18' as shown in FIG. 3.

To accomplish this, the sidewalls 18 of the tank 14 are preferably vertical and the platform 42 is sealed against the sidewalls 18 of the tank 14 by a means for sealing 46 such as a gasket.

When the water is discharged, two events occur at the same time. The vessel 10 tends to rise as it becomes more buoyant by discharging the water 24. Thus the platform 40 moves upwardly against the falling water 24 just as the falling water moves against the platform 40. The water 24 has potential energy by virtue of its raised position, and as it falls, it converts this potential energy into kinetic energy so that when it reaches the platform 40 the water 24 has converted all of its potential energy into kinetic energy and is highly energetic. Because the platform 40 is rising to meet the filling water 24, additional kinetic energy is imparted into the filling water 24. In order to discharge this kinetic energy, the falling water must move. It cannot move downwardly because it is blocked by platform 40 and it cannot move in the direction of the vessel 10 because the vessel 10 blocks motion in that direction. The falling water 24 therefore moves away from the vessel 10, toward the shoreline 22 and forms itself into a swell or wave 26, as it moves through the sea 20. If the wave 20 moves toward a beach it will crest as the sea bottom rises to the shoreline.

Preferably, a thrusting means 50, such as a marine prop, is engaged with the vessel 10 in a position, as shown in FIGS. 2–4, for stabilizing the vessel during the discharge of the water 24 from the tank 14. Such stabilization is necessary in order to enable the falling water 24 to move away from the vessel with maximum kinetic energy. First of all, as the water 24 falls against the platform 40, it tends to drive the platform 40 downwardly into the sea 20. This action is undesirable as it allows the falling water to loose kinetic energy in an undesirable way, i.e., not producing waves. It also tends to tip the vessel about its long axis, again loosing kinetic energy in tipping action. To prevent this, the thrusting means 50 is directed at a downward angle and produces thrust in a direction that counteracts the tipping action of the falling water 24 against the platform 40. See force one (F1) and force two (F2) in FIG. 4.

Preferably the platform 40 is concave upward as shown. This enables the falling water 24 to be smoothly diverted from its initial vertically downward direction, as it falls under the influence of gravity, to a horizontal direction away from the vessel 10.

The wave making method of the above described apparatus comprises the steps of positioning the unmoored shallow draft vessel off-shore from the shoreline of the sea in the position whereby the one side of the vessel is in parallel to the shoreline; pumping the sea water into the tank interior to the vessel, lifting the water in the tank to a rim of the side of the tank nearest to the shoreline to thereby dump the water in the tank over the side of the vessel nearest to the shoreline; directing the water from the tank outwardly from the vessel with the curved platform engaged with and extending outwardly from the one side of the vessel, the platform substantially submerged and positioned for receiving the water falling from the tank; thereby creating the wave moving away from the one side of the vessel toward the shoreline.

The method further provides for lifting the water hydraulically to the rim of the tank using the lifting platform shown in the figures and thrusting against a force of the water using a means for counter thrusting, such as the marine prop, at the time the water is discharged from the tank.

The words used in this specification to describe the invention and its various embodiments are to be understood not only in the sense of their commonly defined meanings, but to include by special definition in this specification: structure, material or acts beyond the scope of the commonly defined meanings. Thus if an element can be understood in the context of this specification as including more than one meaning, then its use must be understood as being generic to all possible meanings supported by the specification and by the word or words describing the element.

The definitions of the words or elements of this described invention and its various embodiments are, therefore, defined in this specification to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the invention and its various embodiments below or that a single element may be substituted for two or more elements in a claim.

Changes from the claimed subject matter as viewed by a person with ordinary skill in the art, now known or later devised, are expressly contemplated as being equivalents within the scope of the invention and its various embodiments. Therefore, obvious substitutions now or later known to one with ordinary skill in the art are defined to be within the scope of the defined elements. The invention and its various embodiments are thus to be understood to include what is specifically illustrated and described above, what is conceptually equivalent, what can be obviously substituted, and also what essentially incorporates the essential idea of the invention.

While the invention has been described with reference to at least one preferred embodiment, it is to be clearly understood by those skilled in the art that the invention is not limited thereto. Rather, the scope of the invention is to be interpreted only in conjunction with the appended claims and it is made clear, here, that the inventor(s) believe that the claimed subject matter is the invention.

What is claimed is:

1. A wave making apparatus positioned off-shore from a shoreline of a sea, the apparatus comprising: a shallow draft vessel floating in the sea and presenting one side of the vessel parallel to the shoreline; interior to the vessel, a water tank having an open top defined by spaced apart tank sidewalls, one of the sidewalls, along the one side of the vessel providing a rim positioned below the other of the sidewalls of the tank and substantially above a surface of the sea; a pump engaged with the tank enabling pumping of sea water into the tank; the tank further providing a means for lifting the water in the tank to the open top thereby spilling the water over the one sidewall so that the water falls exterior to the one side of the vessel; and a curved platform engaged with and extending outwardly from the one side of the vessel, the platform submerged and positioned for receiving the water falling from the tank so as to thereby create a wave moving away from the one side of the vessel toward the shoreline and suitable for surfing.

2. The apparatus of claim 1 wherein the water lifting means is a platform mounted on a hydraulic actuator, the platform movable from a position at a bottom of the tank to a position substantially adjacent the rim of the one sidewall of the tank.

3. The apparatus of claim 2 wherein the sidewalls of the tank are vertical and the platform is sealed against the sidewalls of the tank by a means for sealing.

4. The apparatus of claim 3 wherein the sealing means is a gasket.

5. The apparatus of claim 1 further comprising a thrusting means engaged with the vessel in a position for stabilizing the vessel during discharge of water from the tank.

6. A wave making method comprising the steps of: positioning an unmoored shallow draft vessel offshore from a shoreline of a sea in a position whereby one side of the vessel is parallel to the shoreline; pumping sea water into a tank located in the interior of to the vessel, said tank having an open top defined by spaced apart sidewalls, one of the tank sidewalls, along said one side of the vessel providing a rim positioned below the other of the sidewalls of the tank and substantially above a surface of the sea, lifting the water in the tank said rim of a side of the tank nearest to the shoreline to thereby dump the water in the tank over a side of the vessel nearest to the shoreline; directing the water from the tank outwardly from the vessel with a curved platform engaged with and extending outwardly from the one side of the vessel, the platform substantially submerged and positioned for receiving the water falling from the tank; thereby creating a wave moving away from the one side of the vessel toward the shoreline and suitable for surfing.

7. The method of claim 6 wherein the water is lifted hydraulically to the rim of the tank using a lifting platform.

8. The method of claim 1 further comprising the step of thrusting against a force of the water using a counter thrusting means at the time the water is discharged from the tank.

* * * * *